US010571819B2

(12) United States Patent
Ohta

(10) Patent No.: US 10,571,819 B2
(45) Date of Patent: Feb. 25, 2020

(54) YELLOW TONER

(71) Applicant: ZEON CORPORATION, Tokyo (JP)

(72) Inventor: Ryuji Ohta, Tokyo (JP)

(73) Assignee: ZEON CORPORATION, Tokyo (JP)

( * ) Notice: Subject to any disclaimer, the term of this patent is extended or adjusted under 35 U.S.C. 154(b) by 0 days.

(21) Appl. No.: 15/966,386

(22) Filed: Apr. 30, 2018

(65) Prior Publication Data

US 2018/0246433 A1 Aug. 30, 2018

Related U.S. Application Data

(63) Continuation of application No. 15/116,989, filed as application No. PCT/JP2015/054296 on Feb. 17, 2015, now abandoned.

(30) Foreign Application Priority Data

Feb. 17, 2014 (JP) ..... 2014-027372

(51) Int. Cl.

| | |
|---|---|
| ***G03G 9/08*** | (2006.01) |
| ***G03G 9/09*** | (2006.01) |
| ***G03G 9/087*** | (2006.01) |

(52) U.S. Cl.

CPC ..... *G03G 9/08711* (2013.01); *G03G 9/0806* (2013.01); *G03G 9/0812* (2013.01); *G03G 9/0821* (2013.01); *G03G 9/091* (2013.01)

(58) Field of Classification Search

CPC .. G03G 9/08711; G03G 9/091; G03G 9/0926; G03G 9/0812; G03G 9/0806

See application file for complete search history.

(56) References Cited

U.S. PATENT DOCUMENTS

| | | | |
|---|---|---|---|
| 2007/0231726 | A1 | 10/2007 | Yamate et al. |
| 2008/0044752 | A1 | 2/2008 | Nakatani et al. |
| 2009/0202933 | A1 | 8/2009 | Ito |
| 2010/0035171 | A1 | 2/2010 | Watanabe et al. |
| 2010/0266944 | A1 | 10/2010 | Toyoda et al. |
| 2012/0231388 | A1 | 9/2012 | Kawamura et al. |
| 2013/0157187 | A1 | 6/2013 | Zhou et al. |
| 2015/0378274 | A1 | 12/2015 | Abe et al. |
| 2017/0115584 | A1 | 4/2017 | Nakatani et al. |

FOREIGN PATENT DOCUMENTS

| | | | | |
|---|---|---|---|---|
| JP | 9-160299 | A | | 6/1997 |
| JP | 2001249493 | A | * | 9/2001 |
| JP | 2004279894 | A | * | 10/2004 |
| JP | 2008-242240 | | | 10/2008 |
| JP | 2008242240 | A | * | 10/2008 |
| JP | 2011-215179 | A | | 10/2011 |
| JP | 2012-083644 | A | | 4/2012 |
| JP | 2012-123227 | A | | 6/2012 |
| JP | 2013-050606 | | | 3/2013 |
| JP | 2013-113981 | A | | 6/2013 |

OTHER PUBLICATIONS

English language machine translation of JP2001-249493 (Sep. 2001).*

English langauge machine translation of JP 2004-279894 (Oct. 2004).*

English langauge machine translation of JP 2008-242240 (Oct. 2008).*

English language machine translation of JP 2011-215179 (Year: 2011).*

Office Action, dated May 25, 2017, issued in U.S. Appl. No. 15/116,989 (14 pages, w/ PTO-892 and returned PTO/SB/08a.

Office Action, dated Nov. 3, 2017, issued in U.S. Appl. No. 15/116,989 (9 pages).

Notification of Transmittal of Translation of the International Preliminary Report on Patentability (Form PCT/IB/338) issued in counterpart International Application No. PCT/JP2015/054296 with Forms PCT/IB/373 and PCT/ISA/237 (in English; 12 pages).

* cited by examiner

*Primary Examiner* — Christopher D Rodee

(74) *Attorney, Agent, or Firm* — Westerman, Hattori, Daniels & Adrian, LLP

(57) ABSTRACT

Provided is a yellow toner that has excellent pigment dispersibility, and thus gives a high image density and causes little fog. A yellow toner of the present invention includes at least a binder resin and a yellow pigment, wherein the binder resin is a copolymer that contains 67 to 88% by mass of a styrene-based monomer unit and 12 to 33% by mass of a alkyl (meth)acrylate monomer unit, wherein a content of the yellow pigment is 3 to 15 parts by mass with respect to 100 parts by mass of the binder resin; and wherein a interfacial tension of a mixed solution of 9 parts by mass of the yellow pigment, 72 parts by mass of styrene and 28 parts by mass of n-butyl acrylate with respect to water, is 5 to 19 mN/m.

2 Claims, No Drawings

YELLOW TONER

CROSS REFERENCE

This application is a continuation of U.S. application Ser. No. 15/116,989, filed on Aug. 5, 2016, which is a U.S. national stage of International Application No. PCT/JP2015/054296, filed on Feb. 17, 2015, each of which claims priority of Japanese Patent Application No. 2014-027372, filed on Feb. 17, 2014, the entire contents of each of the foregoing being hereby incorporated by reference.

TECHNICAL FIELD

The present invention relates to a yellow toner that can be used in the development in image forming devices utilizing electrophotography such as copying machines, facsimile machines and printers.

BACKGROUND ART

In image forming devices such as an electrophotographic device and an electrostatic recording device, an electrostatic latent image, which is formed on a photosensitive member, is firstly developed with a toner. The formed toner image is then transferred to a transfer material such as paper as necessary, and then fixed by various means such as heating, pressurization or solvent vapor.

In such image forming devices, digital full color copying machines and digital full color printers have begun to be put into practical use. In a digital full color copying machine, a colored image manuscript is subjected to color separation by means of blue, green and red filters, an electrostatic latent image that corresponds to the original colored manuscript and is formed of dots each having a diameter of from 20 to 70 μm is developed by using respective yellow, magenta, cyan and black toners, and a full color image is formed by utilizing subtractive color mixing. Toners for full color having respective colors require similar degrees of tinting powers so that reproduction of accurate tincture is enabled, but among full color toners, yellow toners specifically had a problem of low tinting power.

Therefore, in order to improve tinting power, as a method for selecting a yellow pigment, for example, a method for measuring the interfacial tension with respect to water of a liquid in which a pigment is dispersed in styrene, as described in Patent Literatures 1 and 2, has been suggested.

Patent Literature 1 describes that a polymerizable monomer composition containing a polymerizable monomer (for example, styrene), a yellow pigment, a wax, a resin a (for example, a vinyl-based copolymer) and a resin b (for example, a polyester resin) is used for the production of a yellow toner. In Patent Literature 1, upon the synthesis of toner particles by forming oil droplets of the polymerizable monomer composition in an aqueous medium, and polymerizing the polymerizable monomer, the interfacial tensions (mN/m) of the dispersion of the respective materials in styrene or of styrene with respect to water are defined as follows.

Interfacial tension (styrene)>interfacial tension (yellow pigment)>interfacial tension (resin *b*) — Formula I Interfacial tension (styrene)>interfacial tension (resin *a*)>interfacial tension (resin *b*) — Formula II $0 \leq |\text{interfacial tension (yellow pigment)} - \text{interfacial tension (resin } a)| \leq 10.0$ — Formula III $5.0 \leq \text{interfacial tension (styrene)} - \text{interfacial tension (resin } b) \leq 17.0$ — Formula IV In the invention of Patent Literature 1, the purpose of the selection of the materials so as to satisfy the Formulas I and II is to form an outermost shell by the resin b in each of the oil droplets of the polymerizable monomer composition. Furthermore, in the invention, the purpose of the selection of the materials so as to satisfy the Formulas III and IV is to enhance the dispersibility of the yellow pigment by the resin a in the oil droplets of the polymerizable monomer composition.

Patent Literature 2 describes that a polymerizable monomer composition containing a polymerizable monomer (for example, styrene), yellow colorants (a yellow pigment and C. I. Solvent Yellow 98) and a wax is used. In Patent Literature 2, upon the synthesis of toner particles by forming oil droplets of the polymerizable monomer composition in an aqueous medium, and polymerizing the polymerizable monomer, the interfacial tensions (mN/m) of the respective materials in the yellow colorants with respect to water are defined as follows.

$3.0 \leq (B-A) \leq 15.0$ — Formula V (In the Formula V, the interfacial tension A represents the interfacial tension with respect to water of a dispersion in which the yellow pigment is dispersed in styrene, and the interfacial tension B represents the interfacial tension with respect to water of a solution in which C. I. Solvent yellow 98 is dissolved in styrene.)

In the invention of Patent Literature 2, the purpose of the selection of the yellow colorants so as to satisfy the Formula V is to maintain the dispersion state of the yellow pigment until the polymerization reaction of the polymerizable monomer in the oil droplets is completed, without causing layer separation between the yellow pigment and the dye (C. I. Solvent Yellow 98) in the oil droplets of the polymerizable monomer composition and aggregation of the yellow pigment in the oil droplets.

CITATION LIST

Patent Literatures

Patent Literature 1: Japanese Patent Application Laid-Open (JP-A) No. 2011-215179

Patent Literature 2: JP-A No. 2013-113981

However, there was a problem that the tinting power of the yellow toner is insufficient since the pigment dispersibility is low, and thus the image density is low, even in the pigments selected in the methods disclosed in Patent Literatures 1 and 2.

SUMMARY OF INVENTION

Technical Problem

In the methods disclosed in Patent Literatures 1 and 2, the interfacial tension with respect to water of styrene, and the interfacial tensions with respect to water of dispersion of the toner materials in the styrene are used in selecting the toner materials. However, Patent Literatures 1 and 2 also disclose, besides styrene, other styrene-based monomers such as methylstyrene, (meth)acrylate-based monomers such as methyl methacrylate, and en-based monomers such as cyclohexene, as the polymerizable monomers. Specifically in the case when a monomer having high polarity such as a (meth)acrylic acid ester-based monomer is used together with styrene, the interfacial tension with respect to water becomes relatively less than that in the case when only styrene is used. Furthermore, since styrene tend to aggregate inside of oil droplets more easily than a monomer having high polarity in an aqueous medium, the state of the distribution of the polymerizable monomer in the oil droplets also changes by the use of the monomer having high polarity. Therefore, it cannot be said that the Formulas I to V, which use the interfacial tensions of the styrene and dispersion of the toner materials in the styrene, properly describe the actual state of the oil droplets of the polymerizable monomer composition.

The problem of the present invention is to provide a yellow toner that solves the subject, provides a high image density due to its excellent pigment dispersibility, and causes little fog.

Solution to Problem

The present inventors found that pigment dispersibility deteriorates more as the ratio of an acrylic acid ester in a pigment dispersion increases, and did intensive studies on the interfacial interaction in and out of oil droplets. Consequently, the present inventors focused on that a yellow pigment having excellent pigment dispersibility can be selected by making the composition of dispersion for evaluation closer to the composition of a polymerizable monomers that are used in the production of toner particles in evaluating pigment dispersibility by interfacial tension. That is, the present inventors found that the problem can be solved by using a yellow pigment in which the interfacial tension with respect to water of a mixed liquid containing styrene, n-butyl acrylate and the yellow pigment at a specific ratio is within a specific range.

That is, according to the present invention, provided is a yellow toner comprising at least a binder resin and a yellow pigment, wherein the binder resin is a copolymer that contains 67 to 88% by mass of a styrene-based monomer unit and 12 to 33% by mass of a alkyl (meth)acrylate monomer unit; wherein the styrene-based monomer unit is a monomer unit that relates to at least one kind of monomer selected from the group consisting of styrene, vinyltoluene, methylstyrene and ethylstyrene; wherein the alkyl (meth) acrylate monomer unit is a monomer unit that relates to at least one kind of monomer selected from the group consisting of methyl acrylate, ethyl acrylate, propyl acrylate, butyl acrylate, 2-ethylhexyl acrylate, dimethylaminoethyl acrylate, methyl methacrylate, ethyl methacrylate, propyl methacrylate, butyl methacrylate, 2-ethylhexyl methacrylate and dimethylaminoethyl methacrylate; wherein a content of the yellow pigment is 3 to 15 parts by mass with respect to 100 parts by mass of the binder resin; and wherein a interfacial tension of a mixed solution of 9 parts by mass of the yellow pigment, 72 parts by mass of styrene and 28 parts by mass of n-butyl acrylate with respect to water, is 5 to 19 mN/m.

In the present invention, the yellow pigment is preferably at least one selected from the group consisting of C. I. Pigment Yellow 93, C. I. Pigment Yellow 155 and C. I. Pigment Yellow 180.

Advantageous Effects of Invention

According to the present invention as mentioned above, a yellow toner that gives a high image density and causes little fog under a high temperature-high humidity (H/H) environment is provided, by using a binder resin that is a copolymer containing polymerizable monomer units of a specific composition within a specific range, and a yellow pigment such that the interfacial tension with respect to water of a pigment dispersion having a specific composition is within a specific range.

DESCRIPTION OF EMBODIMENTS

A yellow toner of the present invention includes at least a binder resin and a yellow pigment, wherein the binder resin is a copolymer that contains 67 to 88% by mass of a styrene-based monomer unit and 12 to 33% by mass of a alkyl (meth)acrylate monomer unit; wherein the styrene-based monomer unit is a monomer unit that relates to at least one kind of monomer selected from the group consisting of styrene, vinyltoluene, methylstyrene and ethylstyrene; wherein the alkyl (meth)acrylate monomer unit is a monomer unit that relates to at least one kind of monomer selected from the group consisting of methyl acrylate, ethyl acrylate, propyl acrylate, butyl acrylate, 2-ethylhexylacrylate, dimethylaminoethyl acrylate, methyl methacrylate, ethyl methacrylate, propyl methacrylate, butyl methacrylate, 2-ethylhexyl methacrylate and dimethylaminoethyl methacrylate; wherein a content of the yellow pigment is 3 to 15 parts by mass with respect to 100 parts by mass of the binder resin; and wherein a interfacial tension of a mixed solution of 9 parts by mass of the yellow pigment, 72 parts by mass of styrene and 28 parts by mass of n-butyl acrylate with respect to water, is 5 to 19 mN/m.

Incidentally, in the present invention, the expression "alkyl (meth)acrylate" means both alkyl acrylates and alkyl methacrylates.

The yellow toner of the present invention (hereinafter sometimes simply referred to as "toner") will be explained below.

The yellow toner of the present invention contains at least a binder resin and a yellow pigment.

A method for producing colored resin particles, colored resin particles obtained by this production method, a method for mixing the colored resin particles and an external additive, and a toner of the present invention will be sequentially explained below.

1. Method for Producing Colored Resin Particles

Generally, methods for producing colored resin particles are broadly classified into dry methods such as a pulverization method and wet methods such as an emulsion polymerization agglomeration method, a suspension polymerization method and a solution suspension method. The wet methods are preferable since toners having excellent printing characteristics such as image reproducibility can be easily obtained. Among the wet methods, polymerization methods such as the emulsion polymerization agglomeration method and the suspension polymerization method are preferable since toners which have relatively small particle size distribution in micron order can be easily obtained. Among the polymerization methods, the suspension polymerization method is more preferable.

The emulsion polymerization agglomeration method is a method for producing colored resin particles by polymerizing emulsified polymerizable monomers to obtain a resin microparticle emulsion, and aggregating the resultant resin microparticles with, for example, a colorant dispersion. The solution suspension method is a method for producing colored resin particles by forming droplets of a solution in an aqueous medium, the solution containing toner components such as a binder resin and a colorant dissolved or dispersed in an organic solvent, and removing the organic solvent. The methods can be respectively performed by known methods.

The colored resin particles of the present invention can be produced by employing the wet methods or the dry methods. The suspension polymerization method, which is preferable among the wet methods, is adopted and performed by the following processes.

(A) Suspension Polymerization Method (A-1) Preparation Process of Polymerizable Monomer Composition First, a polymerizable monomer, a yellow pigment, and other additives such as a mold release agent, which are added as necessary, are mixed to prepare a polymerizable monomer composition. For example, a media type dispersing machine is used for the mixing upon preparing the polymerizable monomer composition.

In the present invention, the polymerizable monomer means a monomer having a polymerizable functional group, and the polymerizable monomer is polymerized to form a binder resin. As the polymerizable monomer, styrene-based monomers and alkyl (meth)acrylate monomers are mainly used.

As the styrene-based monomers, styrene, vinyltoluene, methylstyrene and ethylstyrene are used. Only one kind of these monomers may be used, or two or more kinds of these monomers may be used in combination. Among these, it is preferable to use at least any one of styrene, vinyltoluene and methylstyrene, and it is more preferable to use styrene.

As the alkyl (meth)acrylate monomer, methyl acrylate, ethyl acrylate, propyl acrylate, butyl acrylate, 2-ethylhexyl acrylate, dimethylaminoethyl acrylate, methyl methacrylate, ethyl methacrylate, propyl methacrylate, butyl methacrylate, 2-ethylhexyl methacrylate and dimethylaminoethyl methacrylate are used. Only one kind of these monomers may be used, or two or more kinds of these monomers may be used in combination. Among these, it is preferable to use at least any one of ethyl acrylate, propyl acrylate and butyl acrylate, and it is more preferable to use n-butyl acrylate.

The binder resin is a copolymer containing at least from 67 to 88% by mass of the styrene-based monomer unit and from 12 to 33% by mass of the alkyl (meth)acrylate monomer unit. In the case when the styrene-based monomer unit is less than 67% by mass, and in the case when the alkyl (meth)acrylate monomer unit is more than 33% by mass, the ratio of the styrene-based monomer unit to the alkyl (meth) acrylate monomer unit is too small, and thus the obtained toner may have poor heat-resistant shelf stability. On the other hand, in the case when the styrene-based monomer unit is more than 88% by mass, and in the case when the alkyl (meth)acrylate monomer unit is less than 12% by mass, the ratio of the styrene-based monomer unit to the alkyl (meth)acrylate monomer unit is too much, and thus the obtained toner may be poor in low-temperature fixability.

From the viewpoint of keeping the heat-resistant shelf stability and low-temperature fixability of the obtained toner fine with good balance, the content ratio of the styrene-based monomer unit in the copolymer constituting the binder resin is preferably from 70 to 85% by mass, more preferably from 70 to 80% by mass, further preferably from 71 to 77% by mass, and the content ratio of the alkyl (meth)acrylate monomer unit is preferably from 15 to 30% by mass, more preferably from 20 to 30% by mass, further preferably from 23 to 29% by mass.

For the production of the binder resin, polymerizable monomers other than the styrene-based monomers and alkyl (meth)acrylate monomer may also be used. It is preferable to use monovinyl monomers as such polymerizable monomers. Examples of the monovinyl monomers include acrylic acid and methacrylic acid; nitrile compounds such as acrylonitrile and methacrylonitrile; amide compounds such as acrylamide and methacrylamide; and olefins such as ethylene, propylene and butylene. Each of these monovinyl monomers can be used singly, or two or more kinds of these monovinyl monomers can be used in combination. However, in the case when the monovinyl monomers are used, it is preferable that the monovinyl monomers are 3% by mass or less when the total use amount of the styrene-based monomers and alkyl (meth)acrylate monomers is 100% by mass.

In order to improve the hot offset and shelf stability, it is preferable to use any crosslinkable polymerizable monomer together with the styrene-based monomer and alkyl (meth) acrylate monomer. The crosslinkable polymerizable monomer means a monomer having two or more polymerizable functional groups. Examples of the crosslinkable polymerizable monomer include: aromatic divinyl compounds such as divinyl benzene, divinyl naphthalene and derivatives thereof; ester compounds such as ethylene glycol dimethacrylate and diethylene glycol dimethacrylate, in which two or more carboxylic acids having a carbon-carbon double bond are esterified to alcohol having two or more hydroxyl groups; other divinyl compounds such as N,N-divinylaniline and divinyl ether; and compounds having three or more vinyl groups. These crosslinkable polymerizable monomers can be used alone or in combination of two or more kinds.

In the present invention, it is desirable that the amount of the crosslinkable polymerizable monomer to be used is generally from 0.1 to 5 parts by mass, preferably from 0.3 to 2 parts by mass, with respect to 100 parts by mass of the total used amount of the styrene-based monomer and alkyl (meth)acrylate monomer.

Furthermore, it is preferable to use a macromonomer as a part of the polymerizable monomer since the balance of the shelf stability and low-temperature fixability of the toner to be obtained can be improved. The macromonomer is a reactive oligomer or polymer having a polymerizable carbon-carbon unsaturated double bond at the end of a molecular chain and generally having a number average molecular weight of from 1,000 to 30,000. A preferable macromonomer is one capable of providing a polymer having higher glass transition temperature (hereinafter may be referred to as "Tg") than a polymer obtained by the polymerization of the styrene-based monomer and alkyl (meth)acrylate monomer.

The macromonomer to be used is preferably from 0.03 to 5 parts by mass, more preferably from 0.05 to 1 part by mass, with respect to 100 parts by mass of the total used amount of the styrene-based monomer and alkyl (meth) acrylate monomer.

In the present invention, one of the main features is that a yellow pigment that gives a interfacial tension with respect to water of a mixed liquid comprising 9 parts by mass of the yellow pigment, 72 parts by mass of styrene and 28 parts by mass of n-butyl acrylate of from 5 to 19 mN/m, is used as the yellow pigment.

Incidentally, the mixed liquid comprising 9 parts by mass of the yellow pigment, 72 parts by mass of styrene and 28 parts by mass of n-butyl acrylate (hereinafter sometimes referred to as a pigment dispersion) simulates a polymerizable monomer composition of a specific composition, and is used for the measurement and evaluation of the interfacial tension. Since styrene and n-butyl acrylate have low solubility in water, by measuring the interfacial tension with respect to water for a pigment dispersion, the hydrophilicity of the yellow pigment in the pigment dispersion can be mainly measured.

In the case when the value of the interfacial tension of the pigment dispersion with respect to water is less than 5 mN/m, the hydrophilicity of the yellow pigment against the binder resin is too high. Therefore, when this yellow pigment is used in a toner, the exposure of the yellow pigment on the surface of the toner cannot be suppressed, and the particle size distribution of the toner is broaden, and consequently, the volume average particle size of the obtained toner deviates from an intended particle size. Furthermore, in the case when the hydrophilicity of the yellow pigment is high, the image density of the obtained toner becomes poor, and thus fog easily occurs under a high temperature-high humidity environment.

On the other hand, in the case when the value of the interfacial tension with respect to water of the pigment dispersion is more than 19 mN/m, the hydrophilicity of the yellow pigment against the binder resin is too low and the yellow pigment is easily buried in the toner particles, and consequently, the image density becomes poor.

The interfacial tension with respect to water of the pigment dispersion is preferably from 7 to 17 mN/m, more preferably from 10 to 15 mN/m.

As the means for adjusting the interfacial tension of the pigment dispersion, changing the kind of the yellow pigment, subjecting the yellow pigment to surface treatment, are exemplified, for example.

As a method for subjecting the yellow pigment to surface treatment, for example, a method using rosin is exemplified. As the method for subjecting the yellow pigment to surface treatment by specifically using rosin, (1) a dry mixing process, in which rosin and a yellow pigment are subjected to dry mixing, and the mixture is subjected to thermal treatment such as melt kneading as necessary, (2) a wet treatment, in which an alkali aqueous solution of rosin is added to a synthesis solution of a yellow pigment during the production of the pigment, a lake metal salt of, for example, calcium, barium, strontium or manganese is then added to make the rosin insoluble, whereby coating treatment is provided to the surface of the yellow pigment, are exemplified.

Furthermore, the interfacial tension can also be controlled by the crystalline structure and primary particle size of the yellow pigment.

The degree of the treatment can be adjusted by changing, for example, the amounts of treatment agents, treatment time of these surface treatment depending on the kind of the yellow pigment, and a pigment having suitable hydrophilicity can be obtained.

As the method for measuring the interfacial tension of the pigment dispersion with respect to water, a conventionally-known method can be used. For example, droplets of the pigment dispersion are prepared in an ion-exchanged water, and the interfacial tension with respect to water for the droplets can be measured and calculated by using a solid-liquid interface analyzer (manufactured by Kyowa Interface Science Co., Ltd., product name: Drop Master 501). The measurement temperature may be room temperature (from 15 to 30° C.)

As the yellow pigment that can be used in the present invention, for example, compounds such as azo-based pigments such as monoazo pigments and disazo pigments, and condensed polycyclic pigments are used, and for example, C. I. Pigment Yellow 3, 12, 13, 14, 15, 17, 62, 65, 73, 74, 83, 93, 97, 120, 138, 155, 180, 181, 185, 186 and 213 are included.

Among these, the yellow pigment used in the present invention is preferably at least one selected from the group consisting of C. I. Pigment Yellow 93, C. I. Pigment Yellow 155 and C. I. Pigment Yellow 180.

In the present invention, each of the yellow pigments can be used singly, or two or more kinds of the yellow pigments can be used in combination. The content of the yellow pigment is 3 to 15 parts by mass with respect to 100 parts by mass of the polymerizable monomer.

In the case when the yellow pigment is less than 3 parts by mass with respect to 100 parts by mass of the polymerizable monomer, the tinting power is lowered, and an image density is lowered. Furthermore, in the case when the yellow pigment is more than 15 parts by mass with respect to 100 parts by mass of the polymerizable monomer, the low-temperature fixability is lowered, and the print durability is lowered.

The amount of the yellow pigment with respect to 100 parts by mass of the polymerizable monomer is more preferably from 4 to 12 parts by mass, further preferably from 5 to 9 parts by mass.

As another additive, a mold release agent can be added to the polymerizable monomer composition from the viewpoint of improving the mold release property of the toner from a fixing roll during fixing. As the mold release agent, any mold release agents that are generally used as mold release agents for toners can be used without specific limitation.

As the mold release agent, it is preferable to use at least any one of an ester wax and a hydrocarbon-based wax. By using these waxes as the mold release agent, the balance between the low-temperature fixability and shelf stability can be made preferable.

The ester wax that is preferably used as the mold release agent in the present invention is more preferably a polyfunctional ester wax, and examples include pentaerythritol ester compounds such as pentaerythritol tetrapalmitate, pentaerythritol tetrabehenate and pentaerythritol tetrastearate; glycerin ester compounds such as hexaglycerin tetrabehenate tetrapalmitate, hexaglycerin octabehenate, pentaglycerin heptabehenate, tetraglycerin hexabehenate, triglycerin pentabehenate, diglycerin tetrabehenate and glycerin tribehenate; dipentaerythritol ester compounds such as dipentaerythritol hexamyristate and dipentaerythritol hexapalmitate, and among these, dipentaerythritol ester compounds are preferable, and dipentaerythritol hexamyristate is more preferable.

Examples of the hydrocarbon-based wax that is preferably used as the mold release agent in the present invention include polyethylene waxes, polypropylene waxes, Fischer-Tropsch waxes, petroleum-based waxes, and among these, Fischer-Tropsch waxes and petroleum-based waxes are preferable. Petroleum-based waxes are more preferable.

The number average molecular weight of the hydrocarbon-based wax is preferably from 300 to 800, more preferably from 400 to 600. Furthermore, the penetration of the hydrocarbon-based wax measured by JIS K2235 5.4 is preferably from 1 to 10, more preferably from 2 to 7.

Besides the mold release agents, for example, natural waxes such as jojoba; mineral-based waxes such as ozocerite can be used.

One kind or two or more kinds in combination of the waxes may be used as the mold release agent.

The mold release agent is used by preferably from 0.1 to 30 parts by mass, further preferably by from 1 to 20 parts by mass with respect to 100 parts by mass of the total used amount of the styrene-based monomer and the alkyl (meth) acrylate monomer.

As one of other additives, a charge control agent having positively charging ability or negatively charging ability can be used to improve the charging ability of the toner.

The charge control agent is not particularly limited as long as it is generally used as a charge control agent for a toner. Among the charge control agents, a charge control resin having positively charging ability or negatively charging ability is preferably used since the charge control resin is highly compatible with the polymerizable monomer and can impart stable charging ability (charge stability) to the toner particles. From the viewpoint of obtaining a positively-chargeable toner, the charge control resin having positively charging ability is more preferably used.

Examples of the charge control agent having positively charging ability include nigrosine dyes, quaternary ammonium salts, triaminotriphenylmethane compounds, and imidazole compounds; polyamine resins that are preferably used as the charge control resin; and quaternary ammonium group-containing copolymers and quaternary ammonium salt group-containing copolymers.

Examples of the charge control agent having negatively charging ability include: azo dyes containing metal such as Cr, Co, Al and Fe; metal salicylate compounds and metal alkyl salicylate compounds; and sulfonic acid group-containing copolymers, sulfonate group-containing copolymers, carboxylic acid group-containing copolymers and carboxylate group-containing copolymers, which are preferably used as charge control resins.

In the present invention, it is desirable that the amount of the charge control agent to be used is generally from 0.01 to 10 parts by mass, preferably from 0.03 to 8 parts by mass, with respect to 100 parts by mass of the total used amount of the styrene-based monomer and the alkyl (meth)acrylate monomer. If the added amount of the charge control agent is less than 0.01 parts by mass, fog may occur. On the other hand, if the added amount of the charge control agent exceeds 10 parts by mass, printing soiling may occur.

As another additive, a molecular weight modifier is preferably used upon the polymerization of the polymerizable monomer, which is polymerized to be a binder resin.

The molecular weight modifier is not particularly limited as long as it is generally used as a molecular weight modifier for a toner, and examples include mercaptans such as t-dodecyl mercaptan, n-dodecyl mercaptan, n-octyl mercaptan and 2,2,4,6,6-pentamethylheptane-4-thiol; and thiuram disulfides such as tetramethyl thiuram disulfide, tetraethyl thiuram disulfide, tetrabutyl thiuram disulfide, N,N'-dimethyl-N,N'-diphenyl thiuram disulfide and N,N'-dioctadecyl-N,N'-diisopropyl thiuram disulfide. These molecular weight modifiers may be used alone or in combination of two or more kinds.

In the present invention, it is desirable that the rate of the molecular weight modifier to be used is generally from 0.01 to 10 parts by mass, more preferably from 0.1 to 5 parts by mass, with respect to 100 parts by mass of the total used amount of the styrene-based monomer and the alkyl (meth) acrylate monomer.

(A-2) Suspension Process of Obtaining Suspension (Droplets Forming Process)

In the present invention, it is preferable that the polymerizable monomer composition comprising at least a polymerizable monomer and a yellow pigment is preferably dispersed in an aqueous medium containing a dispersion stabilizer, and a polymerization initiator is added therein, and the droplets of the polymerizable monomer composition are then formed. The method for forming droplets is not particularly limited. The droplets are formed by means of a device capable of strong stirring such as an in-line type emulsifying and dispersing machine (product name: MILDER; manufactured by Pacific Machinery & Engineering Co., Ltd), and a high-speed emulsification and dispersing machine (product name: T. K. HOMOGENIZING MIXER MARK II; manufactured by PRIMIX Corporation).

Examples of the polymerization initiator include: persulfates such as potassium persulfate and ammonium persulfate; azo compounds such as 4,4'-azobis(4-cyanovaleric acid), 2,2'-azobis(2-methyl-N-(2-hydroxyethyl)propionamide), 2,2'-azobis(2-amidinopropane)dihydrochloride, 2,2'-azobis(2,4-dimethylvaleronitrile) and 2,2'-azobisisobutyronitrile; and organic peroxides such as di-t-butyl peroxide, benzoyl peroxide, t-butyl peroxy-2-ethylhexanoate, t-butyl peroxy diethyl acetate, t-hexyl peroxy-2-ethylbutanoate, diisopropyl peroxydicarbonate, di-t-butyl peroxyisophthalate and t-butyl peroxyisobutyrate. Each of them can be used alone or in combination of two or more kinds. Among them, the organic peroxides are preferably used since they can reduce residual polymerizable monomers and can impart excellent printing durability.

Among the organic peroxides, preferred are peroxy esters, and more preferred are non-aromatic peroxy esters, i.e. peroxy esters having no aromatic ring, since they have excellent initiator efficiency and can reduce residual polymerizable monomers.

The polymerization initiator may be added after dispersing the polymerizable monomer composition to the aqueous medium and before forming droplets as described above, or may be added to the polymerizable monomer composition before the polymerizable monomer composition is dispersed in the aqueous medium.

The added amount of the polymerization initiator used in the polymerization of the polymerizable monomer composition is preferably from 0.1 to 20 parts by mass, more preferably from 0.3 to 15 parts by mass, even more preferably from 1 to 10 parts by mass, with respect to 100 parts by mass of the total used amount of the styrene-based monomer and the alkyl (meth)acrylate monomer.

In the present invention, the aqueous medium means a medium containing water as a main component.

In the present invention, a dispersion stabilizer is preferably added to the aqueous medium. Examples of the dispersion stabilizer include inorganic compounds including sulfates such as barium sulfate and calcium sulfate; carbonates such as barium carbonate, calcium carbonate and magnesium carbonate; phosphates such as calcium phosphate; metal oxides such as aluminum oxide and titanium oxide; and metal hydroxides such as aluminum hydroxide, magnesium hydroxide and iron(II) hydroxide; and organic compounds including water-soluble polymers such as polyvinyl alcohol, methyl cellulose and gelatin; anionic surfactants; nonionic surfactants; and ampholytic surfactants. These dispersion stabilizers can be used alone or in combination of two or more kinds.

Among the above dispersion stabilizers, colloids of inorganic compounds, particularly hardly water-soluble metal hydroxides are preferable. By using the colloids of inorganic compounds, particularly hardly water-soluble metal hydroxides, the colored resin particles can have a narrow particle size distribution, so that the amount of the dispersion stabilizer remained after washing can be reduced, and thus the image can be clearly reproduced by the toner to be obtained, and environmental stability can be excellent.

(A-3) Polymerization Process

After the droplets are formed as described in the above (A-2), the thus obtained aqueous dispersion medium is heated to initiate polymerization, whereby an aqueous dispersion of colored resin particles is formed.

The polymerization temperature of the polymerizable monomer composition is preferably 50° C. or more, more preferably from 60 to 95° C. The polymerization reaction time is preferably from 1 to 20 hours, more preferably from 2 to 15 hours.

The colored resin particle may be used as a polymerized toner directly or after adding an external additive. It is preferable that the colored resin particle is so-called core-shell type (or "capsule type") colored resin particle which is obtained by using the colored resin particle as a core layer and forming a shell layer, which is different from the core layer, around the core layer. The core-shell type colored resin particles can take a balance of lowering fixing temperature and prevention of aggregation at storage, since the core layer including a substance having a low softening point is covered with a substance having a higher softening point.

A method for producing the above-mentioned core-shell type colored resin particles using the colored resin particles is not particularly limited, and can be produced by any conventional method. The in situ polymerization method and the phase separation method are preferable from the viewpoint of production efficiency.

A method for producing the core-shell type colored resin particles according to the in situ polymerization method will be hereinafter described.

A polymerizable monomer for forming a shell layer (a polymerizable monomer for shell) and a polymerization initiator are added to an aqueous dispersion medium to which the colored resin particles are dispersed followed by polymerization, and thus the core-shell type colored resin particles can be obtained.

As the polymerizable monomer for shell, the above-mentioned polymerizable monomer can be similarly used. Among the polymerizable monomers, any of monomers which provide a polymer having Tg of more than 80° C. such as styrene, acrylonitrile and methyl methacrylate is preferably used alone or in combination of two or more kinds.

Examples of the polymerization initiator used for polymerization of the polymerizable monomer for shell include water-soluble polymerization initiators including metal persulfates such as potassium persulfate and ammonium persulfate; and azo-based initiators such as 2,2'-azobis(2-methyl-N-(2-hydroxyethyl)propionamide) and 2,2'-azobis (2-methyl-N-(1,1-bis(hydroxymethyl)2-hydroxyethyl) propionamide). Each of these polymerization initiators can be used alone or in combination of two or more kinds. The amount of the polymerization initiator is preferably from 0.1 to 30 parts by mass, more preferably from 1 to 20 parts by mass, with respect to 100 parts by mass of the polymerizable monomer for shell.

The polymerization temperature of the shell layer is preferably 50° C. or more, more preferably from 60 to 95° C. The polymerization reaction time is preferably from 1 to 20 hours, more preferably from 2 to 15 hours.

(A-4) Processes of Washing, Filtering, Dehydrating and Drying

It is preferable that the aqueous dispersion of the colored resin particles obtained by the polymerization is subjected to operations including filtering, washing for removing the dispersion stabilizer, dehydrating, and drying several times as needed after the polymerization, according to any conventional method.

In the washing method, if the inorganic compound is used as the dispersion stabilizer, it is preferable that an acid or an alkali is added to the aqueous dispersion of colored resin particles; thereby, the dispersion stabilizer is dissolved in water and removed. If a colloid of a hardly water-soluble inorganic hydroxide is used as the dispersion stabilizer, it is preferable to control the pH of the aqueous dispersion of colored resin particles to 6.5 or less by adding an acid. Examples of the acid to be added include inorganic acids such as sulfuric acid, hydrochloric acid and nitric acid, and organic acids such as formic acid and acetic acid. Particularly, sulfuric acid is suitable for high removal efficiency and small impact on production facilities.

The methods for dehydrating and filtering are not particularly limited, and any of various known methods can be used. Examples of the filtration method include a centrifugal filtration method, a vacuum filtration method and a pressure filtration method. Also, the drying method is not particularly limited, and any of various methods can be used.

(B) Pulverization Method

In the case of producing the colored resin particles by employing the pulverization method, the following processes are performed.

First, a binder resin and a yellow pigment, and further other additives such as a mold release agent, which are added as necessary, are mixed by means of a mixer such as a ball mill, a V type mixer, FM Mixer (product name; manufactured by NIPPON COKE & ENGINEERING Co., LTD.), a high-speed dissolver or an internal mixer. Next, the above-obtained mixture is kneaded while heating by means of a press kneader, a twin screw extruding kneader or a roller. The obtained kneaded product is coarsely pulverized by means of a pulverizer such as a hammer mill, a cutter mill or a roller mill, followed by finely pulverizing by means of a pulverizer such as a jet mill or a high-speed rotary pulverizer, and classifying into desired particle diameters by means of a classifier such as a wind classifier or an airflow classifier. Thus, colored resin particles produced by the pulverization method can be obtained.

Incidentally, as the binder resin and the yellow pigment, and other additives such as the mold release agent, which are added as necessary, used in the pulverization method, those used in "(A) Suspension polymerization method" can be used. Similarly as the colored resin particles obtained by "(A) Suspension polymerization method", the colored resin particles obtained by the pulverization method can also be in a form of the core-shell type colored resin particles produced by a method such as the in situ polymerization method.

As the binder resin, other resins that have been broadly used hitherto for toners can be used. Specific examples of the binder resin used in the pulverization method include polystyrene, styrene-butyl acrylate copolymers, polyester resins and epoxy resins.

2. Colored Resin Particles

The colored resin particles are obtained by the production method such as (A) Suspension polymerization method or (B) Pulverization method.

Incidentally, hereinafter, the colored resin particles constituting the toner will be described. The colored resin particles hereinafter include both core-shell type colored resin particles and colored resin particles which are not core-shell type.

In the colored resin particles prepared by the production method, the yellow pigment of 3 to 15 parts by mass is contained with respect to 100 parts by mass of the binder resin.

The volume average particle diameter (Dv) of the colored resin particles is preferably from 4 to 12 μm, more preferably from 5 to 10 μm. If "Dv" is less than 4 μm, the flowability of the toner may lower, the transferability may deteriorate, and the image density may decrease. If "Dv" exceeds 12 μm, the resolution of images may decrease.

As for the colored resin particles, a ratio (Dv/Dn) of the volume average particle diameter (Dv) and the number average particle diameter (Dn) is preferably from 1.00 to 1.30, more preferably from 1.00 to 1.25. If "Dv/Dn" exceeds 1.30, the transferability, image density and resolution of images may decrease. The volume average particle diameter and the number average particle diameter of the colored resin particles can be measured, for example, by means of a particle diameter measuring device (product name: MULTISIZER; manufactured by Beckman Coulter, Inc.), etc.

3. Method for Mixing Colored Resin Particles and External Additive

The colored resin particles mentioned above can be directly used as a toner, but it is preferably used as a toner by mixing and agitating the colored resin particles with an external additive to put the colored resin particles into a state in which the external additive is evenly and preferably added by attaching (externally added) on the surfaces of the colored resin particles. Incidentally, a one-component toner may be mixed and agitated together with carrier particles to form a two-component toner.

The agitator for conducting treatment for adding an external additive is not particularly limited as long as it is an agitator capable of attaching the external additive on the surfaces of the colored resin particles. The treatment for adding an external additive can be conducted by using agitators capable of mixing and agitating, such as FM Mixer (product name; manufactured by NIPPON COKE & ENGINEERING CO., LTD.), SUPER MIXER (product name; manufactured by KAWATA Manufacturing Co., Ltd.), Q MIXER (product name; manufactured by NIPPON COKE & ENGINEERING CO., LTD.), Mechanofusion System (product name; manufactured by Hosokawa Micron Corporation) and MECHANOMILL (product name; manufactured by OKADA SEIKO CO., LTD.).

Examples of the external additive include: inorganic particles comprising silica, titanium oxide, aluminum oxide, zinc oxide, tin oxide, calcium carbonate, calcium phosphate and cerium oxide; and organic particles comprising polymethyl methacrylate resins, silicone resins and melamine resins. Among them, inorganic particles are preferable, and among the inorganic particles, silica and titanium oxide is preferable, and particles comprising silica are more preferable.

Incidentally, these external additives are used alone, or in combination of two or more kinds. In particular, it is preferable to use two or more kinds of silica having different particle diameters in combination.

In the present invention, it is desirable to use the external additive at a rate of generally from 0.05 to 6 parts by mass, preferably from 0.2 to 5 parts by mass, with respect to 100 parts by mass of the colored resin particles. If the added amount of the external additive is less than 0.05 parts by mass, the toner after transfer may be remained. If the added amount of the external additive exceeds 6 parts by mass, fog may occur.

In the yellow toner of the present invention, since a binder resin, which is a copolymer containing polymerizable monomer units of a specific composition within a specific range and a yellow pigment that gives a interfacial tension with respect to water of a pigment dispersion that has a specific composition of from 5 to 19 mN/m is used, a high image density can be given, and fog under a high temperature-high humidity (H/H) environment can be suppressed.

EXAMPLES

Hereinafter, the present invention will be described further in detail with reference to examples and comparative examples. However, the scope of the present invention may not be limited to the following examples. Herein, "part(s)" and are based on mass if not particularly mentioned.

Incidentally, test methods used in the examples and the comparative examples are as follows.

1. Measurement of Interfacial Tension

For pigment dispersions for the evaluation having a given compositions, respectively containing Yellow Pigments 1 to 9, each of which was obtained by subjecting a commercially available yellow pigment to hydrophobization treatment or hydrophilization treatment to thereby adjust the hydrophilicity, the interfacial tensions were measured by the following methods.

Seventy-two parts of styrene, 28 parts of n-butyl acrylate and 9 parts of each yellow pigment were subjected to wet pulverization by using a media type dispersing machine, and the interfacial tension with respect to water was measured for the obtained pigment dispersion.

Specifically, the interfacial tension was measured as a visual field of a lens part by WIDE2 by using a solid-liquid interface analyzer (manufactured by Kyowa Interface Science Co., Ltd., product name: Drop Master 501) under an environment of a temperature of 25° C. The needle used was a needle directed upward in the vertical direction, and the inner diameter of the needle was suitably changed depending on the sample and the tip part of the needle was put into ion exchanged water. Secondly, the needle was connected to a syringe part. A pigment dispersion to be measured was put into the syringe part in a degassed state. By injecting the pigment dispersion from the syringe part, a droplet was prepared on the tip part of the needle in the ion exchanged water. Furthermore, the interfacial tension with water was calculated from the shape of the droplet. The controlling and calculation method for preparing the droplet were conducted by using a measurement analysis system (manufactured by Kyowa Interface Science Co., Ltd.). Incidentally, the calculation was conducted with deeming that the difference of the densities of the water and the pigment dispersion required for the calculation is 0.10 g/cm$^3$. The average value of the values of the ten times of measurements was deemed as the final result of the measurement of the interfacial tension. The result of the obtained interfacial tension is as shown in the following Table 1.

TABLE 1

| Yellow pigment | 1 | 2 | 3 | 4 | 5 |
|---|---|---|---|---|---|
| Pigment species | P. Y. 93 | P. Y. 93 | P. Y. 93 | P. Y. 155 | P. Y. 180 |
| Interfacial tension (mN/m) | 11.2 | 18.3 | 5.7 | 9.1 | 15.0 |

TABLE 1-continued

| Yellow pigment | 6 | 7 | 8 | 9 |
|---|---|---|---|---|
| Pigment species | P. Y. 93 | P. Y. 93 | P. Y. 155 | P. Y. 180 |
| Interfacial tension (mN/m) | 20.4 | 3.4 | 22.4 | 3.0 |

2. Production of Yellow Toner

Example 1

Seventy-five parts of styrene and 25 parts of n-butyl acrylate, 0.3 parts of a polymethacrylic acid ester macromonomer (product name: AA6; manufactured by Toagosei Chemical Industry Co., Ltd., Tg=94° C.), 0.6 parts of divinylbenzene, 1.6 parts of t-dodecyl mercaptan and 6.0 parts of Yellow Pigment 1 were mixed, and the mixture was wet-pulverized by means of a media type pulverizer. One part of a charge controlling resin (manufactured by Fujikura Kasei Co., Ltd., product name: Acrybase FCA-207P) and 6 parts of an A Fatty acid ester wax (manufactured by NOF Corporation, product name: WEPT) were added to the mixture obtained by the wet-pulverization, and the mixture was mixed and dissolved to prepare a polymerizable monomer composition.

Separately, in an agitating chamber, an aqueous solution of 5.9 parts sodium hydroxide dissolved in 50 parts ion-exchanged water was gradually added to an aqueous solution of 10.6 parts magnesium chloride dissolved in 220 parts ion-exchanged water at room temperature under agitation to prepare a magnesium hydroxide colloid dispersion.

The polymerizable monomer composition was charged into the above-obtained magnesium hydroxide colloid dispersion (the amount of the magnesium hydroxide colloid: 6.0 parts) at room temperature and further agitated until the droplets became stable. Then, 5 parts of t-butylperoxy-2-ethylhexanoate as a polymerization initiator was added thereto. The dispersion to which the polymerization initiator had been added was subjected to a high shear agitation at 15,000 rpm by means of an in-line type emulsifying and dispersing machine (product name: MILDER MDN303V; manufactured by Pacific Machinery & Engineering Co., Ltd.). Thus, droplets of the polymerizable monomer composition were formed.

The suspension having the above-obtained droplets of the polymerization monomer composition dispersed (a polymerizable monomer composition dispersion) was charged into a reactor furnished with an agitating blade and the temperature thereof was raised to 90° C. to start polymerization reaction. When the polymerization conversion reached almost 100%, 2 parts of methyl methacrylate (a polymerizable monomer for shell) and 0.1 parts of 2,2'-azobis(2-methyl-N-(2-hydroxyethyl)-propionamide) (a polymerization initiator for shell; product name: VA-086; manufactured by Wako Pure Chemical Industries, Ltd.; water-soluble) dissolved in 20 parts ion-exchanged water were added in the reactor. The temperature was raised to 95° C., the polymerization was maintained for 4 hours at 95° C., and the reactor was cooled by water to stop the reaction, whereby an aqueous dispersion of colored resin particles was obtained.

The above-obtained aqueous dispersion of colored resin particles was subjected to acid washing, in which sulfuric acid was added dropwise to give a pH of 6.5 or less while agitating at room temperature. Then, separation by filtration was performed, and thus a solid content was obtained. After 500 parts ion-exchanged water was added to the solid content to make a slurry again, water washing treatment (washing, filtration and dehydration) was repeatedly performed several times. Next, separation by filtration was performed and the thus-obtained solid content was placed in a container of a dryer and dried at 45° C. for 48 hours, whereby dried colored resin particles were obtained.

To 100 parts of the above-obtained colored resin particles were added 0.6 parts of hydrophobized silica fine particles having a number average primary particle diameter of 7 nm and 1 part of hydrophobized silica fine particles having a number average primary particle diameter of 35 nm were added, and the mixture was mixed by means of a high speed agitator (product name: FM Mixer; manufactured by NIPPON COKE & ENGINEERING CO., LTD.), and the external additives were externally added. Thus, Yellow Toner 1 having a volume average particle diameter Dv of 7.6 μm and a particle diameter distribution Dv/Dn of 1.22 was produced. The test results are shown in Table 2.

Examples 2 to 5 and Comparative Examples 1 to 4

The yellow toners of Examples 2 to 5 and Comparative Examples 1 to 4 were obtained in a similar manner to Example 1, except that Yellow Pigment 1 was changed to Yellow Pigments 2 to 9 in Example 1.

Example 6

The yellow toner of Example 6 was obtained in a similar manner to Example 1, except that the addition amounts of the styrene and n-butyl acrylate were changed to 85 parts of styrene and 15 parts of n-butyl acrylate in Example 1.

Example 7

The yellow toner of Example 7 was obtained in a similar manner to Example 1, except that the addition amounts of the styrene and n-butyl acrylate were changed to 70 parts of styrene and 30 parts of n-butyl acrylate in Example 1.

Comparative Example 5

The yellow toner of Comparative Example 5 was obtained in a similar manner to Example 6, except that Yellow Pigment 1 was changed to Yellow Pigment 7 in Example 6.

Comparative Example 6

The yellow toner of Comparative Example 6 was obtained in a similar manner to Example 7, except that Yellow Pigment 1 was changed to Yellow Pigment 7 in Example 7.

3. Evaluation of Properties of Colored Resin Particles and Toners

For Examples 1 to 7 and Comparative Examples 1 to 6, and the colored resin particles used in the toners, the properties were examined. The details are as follows. The results of the evaluation are shown in Table 2.

3-1. Measurement of Particle Diameters

The volume average particle diameter Dv, number average particle diameter Dn and particle size distribution Dv/Dn of the yellow toner were measured by means of a particle size measurement device (product name: MULTISIZER, manufactured by Beckman Coulter, Inc.,). The measurement by MULTISIZER was conducted under conditions of an aperture diameter of 100 μm, a dispersion medium of ISOTON II (product name), a concentration of 10%, and the number of the measured particles of 100,000.

Specifically, 0.2 g of a toner sample was placed in a beaker, and an aqueous solution of an alkylbenzene sulfonate (product name: DRIWEL; manufactured by FUJIFILM Corporation) was added thereto as a dispersant. Two mL of a dispersion medium was further added thereto to wet the toner, 10 mL of a dispersion medium was then added, and the mixture was dispersed in an ultrasonic dispersing machine for one minute, and the dispersion was measured by the particle size measurement device.

3-2. Image Density

The yellow toner was put into a commercially available printer of a nonmagnetic one-component developing system (printing speed: 20 sheets/min), and a 50 mm×50 mm square shape was solid-printed on copying paper under an environment of a temperature of 23° C. and a humidity of 50%. At that time, a developing amount M/A, which is the amount of the yellow toner on the copying paper, was varied by varying the developing bias voltage. The unfixed image was taken from the printer, the yellow toner developed on the copying paper was blown off with air, and the developing amount M/A was calculated from the following formula based on the masses before and after the blown off of the yellow toner.

$$M/A\ (\mathrm{mg/cm^2})=(W1-W2)/25\ \mathrm{cm^2}$$

W1=the mass of the copying paper before the blown off of the polymerized toner (mg)

W2=the mass of the copying paper after the blown off of the polymerized toner

The print density of a 5 mm×5 mm square solid print fixed image with M/A=0.45 mg/cm$^2$ was measured by using a reflection type density meter (product name: SpectroEye, manufactured by X-Rite). A preferable image density is 1.25 or more, further preferably 1.30 or more.

3-3. Evaluation of Fog Under High Temperature-High Humidity (H/H) Environment

The commercially available printer of a nonmagnetic one-component developing system and the yellow toner to be evaluated were left under a high temperature-high humidity (H/H) environment at a temperature of 35° C. and a humidity of 80% all night and all day, and fog was then measured.

The method for measuring fog is as follows. Firstly, the color tone of paper that was not used for the printing was measured and deemed as a reference value ($E_0$). Secondly, a white solid was printed by using the yellow toner by the printer, and the color tone of the optional six portions on the white solid ($E_1$ to $E_6$) were measured. The difference (ΔE) between each of the color tone ($E_1$ to $E_6$) and the reference value ($E_0$) was calculated, and the largest ΔE was deemed as the fog value of the toner. A smaller fog value indicates smaller fog and better printing. Furthermore, the color tone was measured by using the reflection type density meter.

The results of the evaluation of the yellow toners of Examples 1 to 7 and Comparative Examples 1 to 6 are shown in the following Table 2 together with the kinds of the yellow pigment.

TABLE 2

| | Example 1 | Example 2 | Example 3 | Example 4 | Example 5 | Example 6 | Example 7 |
|---|---|---|---|---|---|---|---|
| Yellow pigment | 1 | 2 | 3 | 4 | 5 | 1 | 1 |
| Dv (μm) | 7.6 | 7.6 | 7.8 | 7.2 | 7.7 | 7.8 | 7.6 |
| Dv/Dn | 1.22 | 1.22 | 1.24 | 1.24 | 1.24 | 1.23 | 1.21 |
| Image density | 1.33 | 1.31 | 1.36 | 1.37 | 1.31 | 1.35 | 1.32 |
| H/H fog | 0.8 | 0.6 | 1.3 | 1.4 | 0.6 | 1.0 | 0.7 |

| | Comparative Example 1 | Comparative Example 2 | Comparative Example 3 | Comparative Example 4 | Comparative Example 5 | Comparative Example 6 |
|---|---|---|---|---|---|---|
| Yellow pigment | 6 | 7 | 8 | 9 | 7 | 7 |
| Dv (μm) | 7.4 | 8.4 | 7.2 | 8.7 | 8.3 | 8.1 |
| Dv/Dn | 1.21 | 1.31 | 1.20 | 1.41 | 1.32 | 1.29 |
| Image density | 1.27 | 1.24 | 1.21 | 1.17 | 1.21 | 1.25 |
| H/H fog | 0.5 | 5.8 | 0.5 | 5.7 | 6.3 | 5.5 |

4. Evaluation of Toner

The results of the evaluation of the toners will be considered below with referring to Tables 1 and 2.

From Table 1, in Yellow Pigment 6, which was used in the toner of Comparative Example 1, the interfacial tension of the pigment dispersion is 20.4 mN/m. Furthermore, in Yellow Pigment 8, which was used in the toner of Comparative Example 3, the interfacial tension of the pigment dispersion is 22.4 mN/m. From Table 2, both of the toners of Comparative Examples 1 and 3 have a H/H fog value of 0.5, and thus no problem of fog is observed.

However, the image densities of the toners of Comparative Examples 1 and 3 are low as 1.27 or 1.21.

The reason is considered as follows. Since the hydrophilicity of the yellow pigment is too low with respect to the polarity of the polymerizable monomer composition of 75 parts of styrene and 25 parts of n-butyl acrylate, the yellow pigment tends to be unevenly distributed to the inside of the toner particles, and consequently the image density is low.

From Table 1, in Yellow Pigment 7, which was used in the toner of Comparative Example 2, the interfacial tension of the pigment dispersion is 3.4 mN/m. Furthermore, in Yellow Pigment 9, which was used in the toner of Comparative Example 4, the interfacial tension of the pigment dispersion is 3.0 mN/m.

From Table 2, the particle size distributions (Dv/Dn) of the toners of Comparative Examples 2 and 4 are large as 1.31 or 1.41. Furthermore, the image densities of the toners of Comparative Examples 2 and 4 are low as 1.24 or 1.17, and the values of the H/H fog of these toners are high as 5.8 or 5.7. The reason is considered as follows. Since the hydrophilicity of the yellow pigment is too high with respect to the polarity of the polymerizable monomer composition of 75 parts of styrene and 25 parts of n-butyl acrylate, the uneven distribution of the yellow pigment to the vicinity of the surface layers of the toner particles cannot be suppressed, and thus the particle size distribution of the toner is broaden and the volume average particle size of the toner deviates from the intended particle size, and furthermore, the image density becomes poor, and fog easily occurs under a high temperature-high humidity environment.

On the other hand, from Table 1, in Yellow Pigments 1 to 5 used in the toners of Examples 1 to 7, the interfacial tension of the pigment dispersion is from 5.7 to 18.3 mN/m.

From Table 2, the image densities of the toners of Examples 1 to 5 are high as from 1.31 to 1.37, and the values of the H/H fog of these toners are low as from 0.6 to 1.4.

Accordingly, it is understood that the toners each using a yellow pigment having a suitable hydrophilicity such that the interfacial tension with respect to water of the pigment dispersion is from 5 to 19 mN/m for a polymerizable monomer composition of 75 parts of styrene and 25 parts of n-butyl acrylate are toners that give a high image density and cause little fog, due to the excellent dispersibility of the pigment.

Furthermore, from Table 2, the image densities of the toners of Examples 6 and 7 are high as 1.35 or 1.32, and the values of the H/H fog of these toners are low as 1.0 or 0.7.

This shows that, when Yellow Pigment 1, which gives a interfacial tension of a pigment dispersion of 11.2 mN/m, is used, a toner having excellent pigment dispersibility can be obtained even in the cases when the polarity of the polymerizable monomer composition is changed by adjusting the composition of the polymerizable monomer composition within a practically realistic range, such as 85 parts of styrene and 15 parts of n-butyl acrylate, or 70 parts of styrene and 30 parts of n-butyl acrylate.

On the other hand, from Table 2, the image densities of the toners of Comparative Examples 5 and 6 are low as 1.21 or 1.25, and the values of the H/H fog of these toners are high as 6.3 or 5.5. This shows that, when Yellow Pigment 7, which gives a interfacial tension of a pigment dispersion of 3.4 mN/m, is used, a toner having excellent pigment dispersibility cannot be obtained even in the cases when the polarity of the polymerizable monomer composition is adjusted within a practically realistic range, such as 85 parts of styrene and 15 parts of n-butyl acrylate, or 70 parts of styrene and 30 parts of n-butyl acrylate.

Accordingly, it is understood that a toner containing 3 to 15 parts by mass of a yellow pigment that gives a interfacial tension with respect to water of a pigment dispersion of from 5 to 19 mN/m with respect to 100 parts by mass of a binder resin containing 67 to 88% by mass of a styrene-based monomer unit and 12 to 33% by mass of an acrylic acid alkyl monomer unit has excellent pigment dispersibility, and thus is a toner that gives a high image density and causes little fog.

The invention claimed is:

1. A method for producing a yellow toner comprising colored resin particles which comprise a binder resin and a treated yellow pigment, wherein the binder resin is a copolymer that contains 67 to 88% by mass of a styrene-based monomer unit and 12 to 33% by mass of an alkyl (meth)acrylate monomer unit;

wherein a styrene-based monomer of the styrene-based monomer unit is at least one kind of monomer selected from the group consisting of styrene, vinyltoluene, methylstyrene and ethylstyrene;

wherein an alkyl (meth)acrylate monomer of the alkyl (meth)acrylate monomer unit is at least one kind of monomer selected from the group consisting of methyl acrylate, ethyl acrylate, propyl acrylate, butyl acrylate, 2-ethylhexyl acrylate, dimethylaminoethyl acrylate, methyl methacrylate, ethyl methacrylate, propyl methacrylate, butyl methacrylate, 2-ethylhexyl methacrylate and dimethylaminoethyl methacrylate;

wherein a content of the treated yellow pigment is 3 to 15 parts by mass with respect to 100 parts by mass of the binder resin; and wherein the method comprises steps of:

subjecting a yellow pigment to hydrophobization or hydrophilization treatment to prepare the treated yellow pigment that gives an interfacial tension of 7 to 17 mN/m of a mixed solution with respect to water, provided that the mixed solution is composed of 9 parts by mass of the treated yellow pigment, 72 parts by mass of styrene, and 28 parts by mass of n-butyl acrylate;

dispersing a polymerizable monomer composition comprising the treated yellow pigment and a polymerizable monomer comprising the styrene-based monomer and the alkyl (meth)acrylate monomer, in an aqueous medium to prepare a suspension in which droplets of the polymerizable monomer composition are dispersed in the aqueous medium; and subjecting the suspension to polymerization process to obtain the colored resin particles comprising the binder resin and the treated yellow pigment; and wherein a content of the treated yellow pigment in the polymerizable monomer composition is 3 to 15 parts by mass with respect to 100 parts by mass of the polymerizable monomer.

2. The method for producing the yellow toner according to claim 1, wherein the yellow pigment is at least one selected from the group consisting of C. I. Pigment Yellow 93, C. I. Pigment Yellow 155 and C. I. Pigment Yellow 180.

* * * * *